US006044690A

United States Patent [19]

Williams

[11] Patent Number: 6,044,690

[45] Date of Patent: Apr. 4, 2000

[54] SHEARABLE MULTI-GAGE BLOWOUT PREVENTER TEST TOOL AND METHOD

[76] Inventor: J. Terrell Williams, P.O. Box 1973, Lake Charles, La. 70602

[21] Appl. No.: 09/072,866

[22] Filed: May 5, 1998

[51] Int. Cl.[7] ..... G01M 3/28

[52] U.S. Cl. ..... 73/40.5 R; 73/49.1; 166/250.08

[58] Field of Search ..... 73/40.5 R, 49.1, 73/49.5, 49.6, 49.8; 166/250.08

[56] References Cited

U.S. PATENT DOCUMENTS

| | | | |
|---|---|---|---|
| 2,982,125 | 5/1961 | Gilreath | 73/40.5 R |
| 3,071,960 | 1/1963 | Knapp et al. | 73/40.5 R |
| 4,152,924 | 5/1979 | Mayo | 73/40.5 R |
| 4,373,380 | 2/1983 | Mayo | 73/40.5 R |
| 4,554,976 | 11/1985 | Hynes et al. | 73/40.5 R X |
| 4,881,598 | 11/1989 | Stockinger et al. | 73/40.5 R X |

*Primary Examiner*—Daniel S. Larkin
*Attorney, Agent, or Firm*—Kenneth A. Roddy

[57] ABSTRACT

A shearable multi-gage blowout preventer test tool for testing different size ram and annular BOP's in one trip has an inner tube and an outer test tube assembly connected in telescoping relation. The inner tube is connected to a bottom sub and a release sub connected to the bottom end of the outer test tube assembly is slidably mounted on the inner tube. The outer tube assembly has a plurality of pipe gage diameters corresponding to different drill pipe sizes. A top sub at the top end of the outer tube assembly connects to the drill string. The release sub and outer tube assembly is connected to the bottom sub in the collapsed position. The bottom sub is connected to a test plug and tail pipe assembly and the tool is lowered through the riser pipe and BOP stack to set the test plug in the well. A wireline retrievable dart is engaged in the inner tube and drilling fluid flow bypasses the inner tube through fluid passageways between the inner and outer tube assemblies and is vented through ports in the release sub. Ram and annular BOPs are tested against a first set of the pipe gage diameters with the tool in its collapsed condition, and then the outer tube assembly is uncoupled from the bottom sub and lifted to its extended position such that another set of the pipe gage diameters are positioned within the BOP stack and the rams and annular BOPs are then tested against the second axially positioned set of corresponding pipe gage diameters.

8 Claims, 8 Drawing Sheets

SHEARABLE MULTI-GAGE BLOWOUT PREVENTER TEST TOOL AND METHOD

BACKGROUND OF THE INVENTION

1. Field of the Invention

This invention relates generally to high-pressure blowout preventer testing in subsea environments, and more particularly to a telescoping shearable multi-gage blowout preventer test tool and method for testing different size ram and annular BOP's, or choke and kill lines and valves in one trip.

2. Brief Description of the Prior Art

Blowout preventer or BOP stacks are connected to oil and gas wells on the sea floor for controlling the well during drilling rig operations. The blowout preventer stack will usually include several blowout preventers of various types which are capable of closing in the well in the event of excessive pressures downhole. For example, a typical blowout preventer stack may include several ram-type blowout preventers (blind-ram and/or variable ram), and one or more annular blowout preventers connected above the ram-type blowout preventers. A riser pipe connected to the uppermost blowout preventer extends to the drilling rig at the surface.

Typically, subsea wells use a tapered drill string system wherein a larger diameter drill string is used for drilling an initial portion of the well, and successively smaller diameter drill strings for drilling the lower portions of the well. Thus, the blowout preventer system must be capable, for example, of sealing off the annular space surrounding 5½" and/or 5" O.D. pipe and also 3½" O.D. drill pipe.

Testing of the blowout preventer stack is typically accomplished by connecting a test plug to a length of drill pipe of the diameter to be tested, running it into the well such that the test plug seals in the well, and then testing the blowout preventer system for that particular size of drill pipe. The first drill string and test plug is retrieved from the well, and the process is repeated for each size of drill pipe used in the system.

This repetitive tripping or running and retrieving the test drill string to test against each of the different size drill pipes requires excessive time, labor, and expense, particularly in subsea wells which may be several thousand feet below the drilling platform.

There are several patents which disclose various blowout preventer testing apparatus and methods.

Crain, U.S. Pat. No. 4,347,733, discloses a blowout preventer test system utilizing a pipe nipple threaded at both ends and having a central bore through which fluid is conveyed. A reduced orifice at the central portion of the bore constricts fluid flow through the bore. The nipple has instrumentation taps through its side wall for attaching a differential pressure recording device.

Hynes et al, U.S. Pat. No. 4,554,976, discloses a blowout preventer test tool having an upper body and lower sealing body releasably connected by left-hand threads, and a check valve landed in the bore of the tool to prevent downward flow of fluid but allow upward flow and the attached drill pipe for detecting leaks of the sealing tool during pressure testing. During testing of a shear ram blowout preventer, the upper body is disconnected from the lower body by turning the drill pipe to the right. Raising the drill pipe then causes the upper body to shift a set of right-hand threads into position and move the upper body and drill pipe above the shear ram BOP allowing it to be closed for pressure testing.

Stockinger et al, U.S. Pat. No. 4,881,598, discloses a blowout preventer testing apparatus designed to close a smaller drill string pipe and a larger drill string pipe. The apparatus includes a first elongated cylindrical testing mandrel having an O.D. of the smaller drill pipe telescopingly received inside of a second elongated cylindrical testing mandrel having an O.D. of the larger drill pipe. The mandrels are releasably locked together in an extended position for testing against the first mandrel, and released to a collapsed position for testing against the second mandrel without tripping the apparatus out of the well.

The present invention is distinguished over the prior art in general, and these patents in particular by a shearable multi-gage blowout preventer test tool for testing different size ram and annular BOP's in one trip. The present tool has an inner tube and an outer test tube assembly connected in telescoping relation. The inner tube is connected to a bottom sub and a release sub connected to the bottom end of the outer test tube assembly is slidably mounted on the inner tube. The outer tube assembly has a plurality of pipe gage diameters corresponding to different drill pipe sizes. A top sub at the top end of the outer tube assembly connects to the drill string. The release sub and outer tube assembly is connected to the bottom sub in the collapsed position. The bottom sub is connected to a test plug and tail pipe assembly and the tool is lowered through the riser pipe and BOP stack to set the test plug in the well. A wireline retrievable dart is engaged in the inner tube and drilling fluid flow bypasses the inner tube through fluid passageways between the inner and outer tube assemblies and is vented through ports in the release sub. Ram and annular BOPs are tested against a first set of the pipe gage diameters with the tool in its collapsed condition, and then the outer tube assembly is uncoupled from the bottom sub and lifted to its extended position such that another set of the pipe gage diameters are positioned within the BOP stack and the rams and annular BOPs are then tested against the second axially positioned set of corresponding pipe gage diameters.

SUMMARY OF THE INVENTION

It is therefore an object of the present invention to provide a shearable multi-gage blowout preventer test tool and method for testing different size rams, variable bore rams, annular BOP's, or choke and kill lines and valves in one trip.

It is another object of this invention to provide a shearable multi-gage blowout preventer test tool having an exterior with different longitudinally spaced pipe gage diameters for testing different size rams, variable bore rams, annular BOP's, or choke and kill lines and valves in one trip.

Another object of this invention is to provide a shearable multi-gage blowout preventer test tool and method for testing different size rams, variable bore rams, annular BOP's, or choke and kill lines and valves wherein all tubular members of the outer test tube assembly are designed to provide a wall thickness, including the pipe gage diameters, sufficient to allow the tubular members to easily be sheared in the event that it becomes necessary.

Another object of this invention is to provide a longitudinally telescoping shearable multi-gage blowout preventer test tool having different longitudinally spaced pipe gage diameters which can be accurately positioned for testing different selected size rams, variable bore rams, annular BOP's, or choke and kill lines.

A further object of this invention is to provide a shearable multi-gage blowout preventer test tool utilizing a wireline retrievable dart sealing member which allows full fluid flow while tripping or for safety.

A still further object of this invention is to provide a shearable multi-gage blowout preventer test tool which is simple in construction and rugged and reliable in operation.

Other objects of the invention will become apparent from time to time throughout the specification and claims as hereinafter related.

The above noted objects and other objects of the invention are accomplished by the present shearable multi-gage blowout preventer test tool for testing different size ram and annular BOP's in one trip. The tool has an inner tube and an outer test tube assembly connected in telescoping relation. The inner tube is connected to a bottom sub and a release sub connected to the bottom end of the outer test tube assembly is slidably mounted on the inner tube. The outer tube assembly has a plurality of pipe gage diameters corresponding to different drill pipe sizes. A top sub at the top end of the outer tube assembly connects to the drill string. The release sub and outer tube assembly is connected to the bottom sub in the collapsed position. The bottom sub is connected to a test plug and tail pipe assembly and the tool is lowered through the riser pipe and BOP stack to set the test plug in the wellhead. A wireline retrievable dart is engaged in the inner tube and drilling fluid flow bypasses the inner tube through fluid passageways between the inner and outer tube assemblies and is vented through ports in the release sub. Ram and annular BOPs are tested against a first set of the pipe gage diameters with the tool in its collapsed condition, and then the outer tube assembly is uncoupled from the bottom sub and lifted to its extended position such that another set of the pipe gage diameters are positioned within the BOP stack and the rams and annular BOPs are then tested against the second axially positioned set of corresponding pipe gage diameters.

DESCRIPTION OF THE PREFERRED EMBODIMENT

Figure 1:
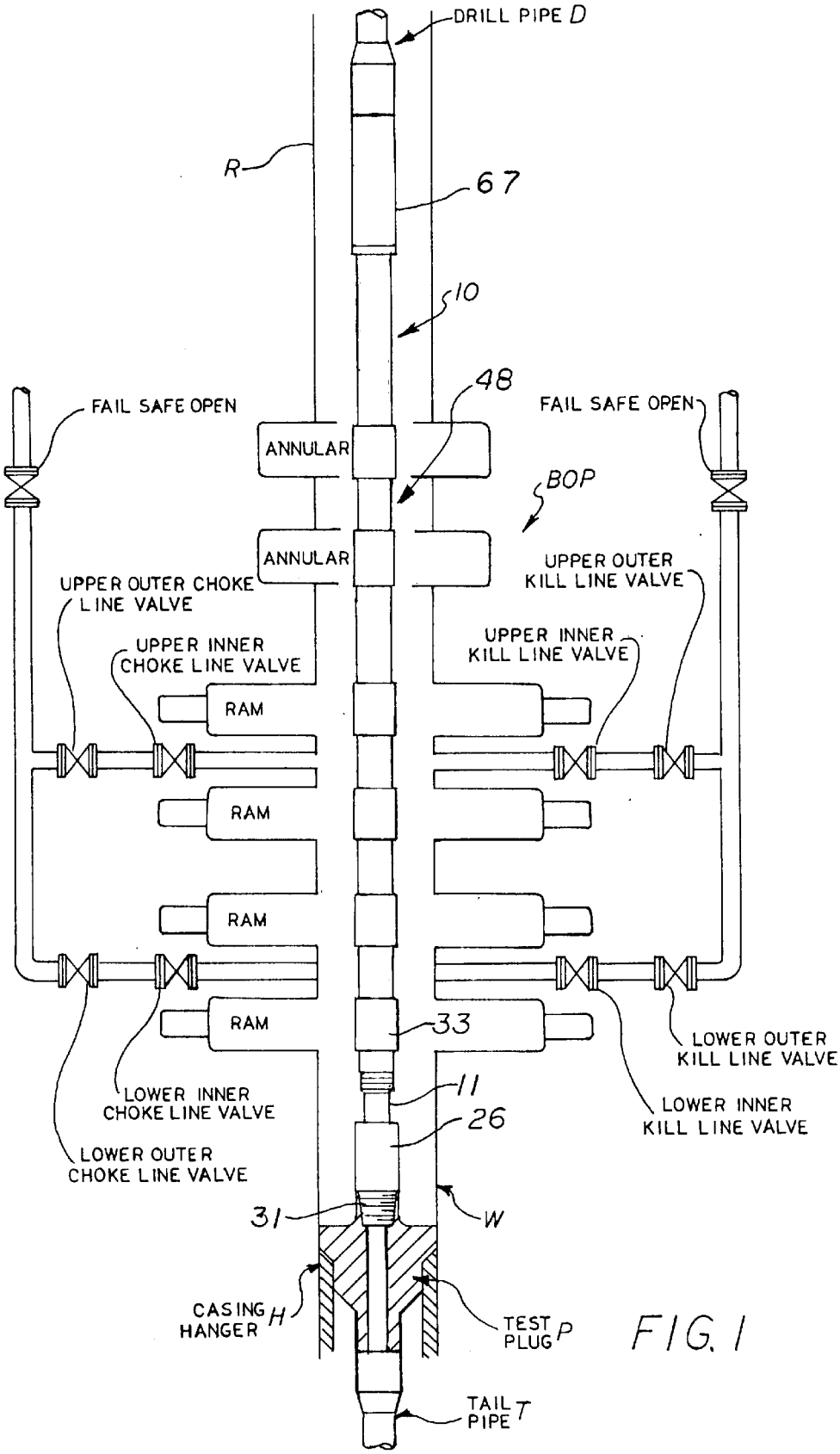
FIG. 1 is a schematic elevation view in partial cross section showing a shearable multi-gage blowout preventer test tool in accordance with a preferred embodiment of the invention attached to a drill string inside a conventional subsea BOP stack.

Referring to the drawings by numerals of reference, there is shown schematically in FIG. 1, a typical conventional blowout preventer stack (BOP) connected to a subsea wellhead W on the sea floor. In the illustrated example, the blowout preventer stack includes several ram-type blowout preventers (blind-ram, shear-ram, and/or variable ram), and a pair of annular blowout preventers connected above the ram-type blowout preventers. A riser pipe R connected to the uppermost blowout preventer extends to the drilling rig at the surface (not shown). The wellhead W includes a casing hanger H, and the BOP stack includes the conventional piping with choke valves, kill valves, and fail safe valves.

A shearable multi-gage blowout preventer test tool 10 in accordance with a preferred embodiment of the invention is shown inside the BOP stack and connected at its upper end to the lower joint of a drill pipe string D and having a conventional test plug P connected at its lower end which is seated in the casing hanger of the wellhead.

Referring additionally to FIGS. 2A, 2B, 3A, 3B, and 4, the shearable multi-gage BOP test tool 10 is an elongate tubular apparatus including an elongate inner tube member 11 slidably received in and surrounded by an elongate outer test tube assembly 48 in axially telescoping relation.

Figure 5:
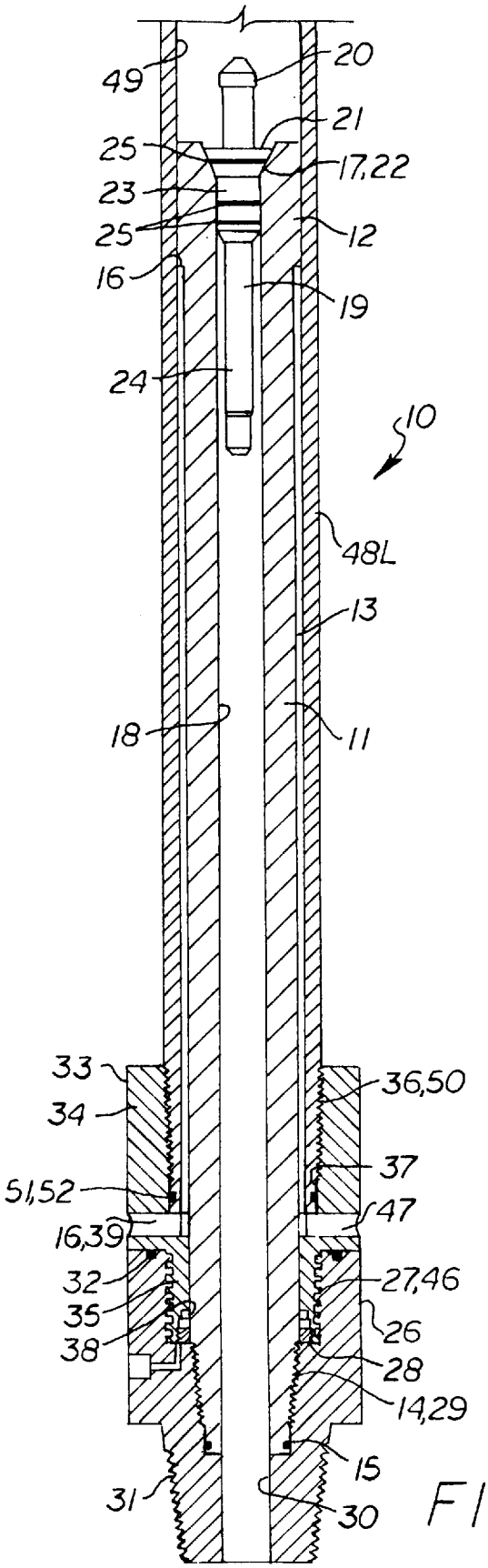
FIG. 5 is a longitudinal cross section through the release sub, bottom sub, and inner tube of the shearable multi-gage blowout preventer test tool in the collapsed condition.
Figure 6:
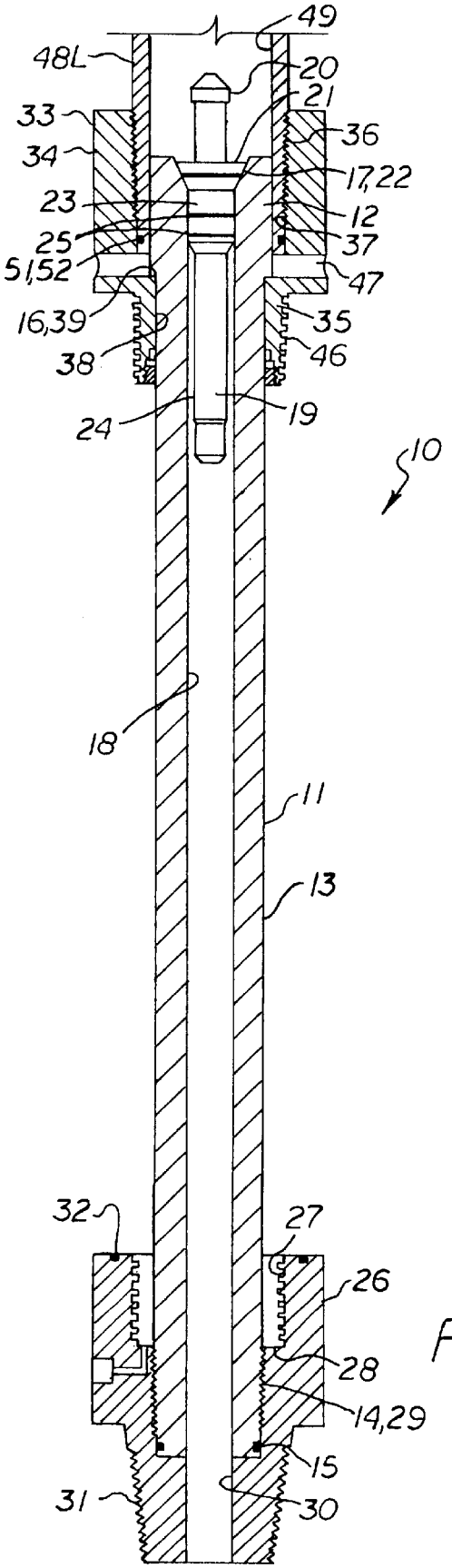
FIG. 6 is a longitudinal cross section through the release sub, bottom sub, and inner tube of the shearable multi-gage blowout preventer test tool in the extended condition.
Figure 7:
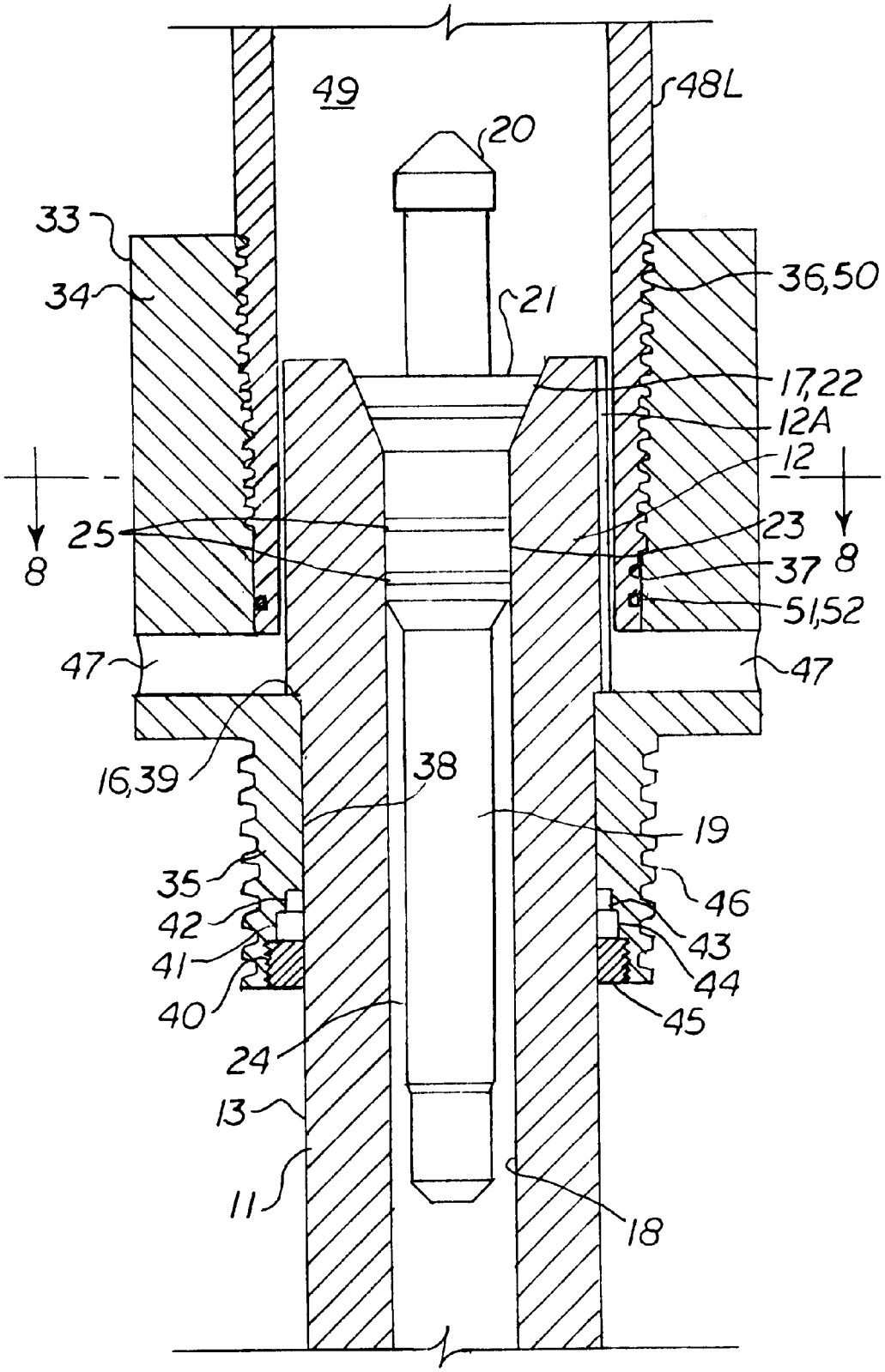
FIG. 7 is a longitudinal cross section through the upper portion of the inner tube and the release sub, showing the components in greater detail.

Referring additionally to FIGS. 5, 6, and 7 the exterior of the inner tube 11 has an enlarged diameter upper portion 12, a reduced diameter portion 13 exending downwardly therefrom with male threads 14 and an annular seal 15 at its bottom end. The enlarged diameter upper portion 12 and reduced diameter portion 13 define a downward facing annular stop shoulder 16 therebetween. The interior of the inner tube 11 has a tapered bore 17 extending downwardly and inwardly from the top end and terminating in a central bore 18.

As described in detail hereinafter, a wireline retrievable dart 19 is removably received in the upper end of the inner tube 12. The dart 19 has a fishing neck 20 at its top end extending upwardly from a flat upward facing surface 21, a downward and inwardly tapered portion 22 below the fishing neck, and a straight intermediate portion 23 extending downward from the tapered portion terminating in a reduced diameter straight lower portion 24. The tapered portion 22 and intermediate portion 23 are provided with annular seals 25. The tapered portion 22 is received in the tapered bore 17, the intermediate portion 23 is received in the central bore 18, and the reduced diameter lower portion 24 extends downwardly into the central bore defining an annulus therebetween. When subjected to downward force, the seals 25 form a fluid sealing relation with the tapered bore 17 and central bore 18.

The bottom end of the inner tube 11 is threadedly engaged in a bottom sub 26. The interior of the bottom sub 26 has a coarse left-hand straight female threaded portion 27 which extends downwardly a distance from its top end terminating at an annular shoulder 28, a tapered female threaded portion 29 extending downwardly from the shoulder 28, and a central bore 30. The male threads 14 at the bottom end of the inner tube 11 are threadedly engaged in the female threads 29 and an annular seal 15 beneath the threads seals the threaded connection 14,29. The exterior of the bottom sub 26 is provided with male threads 31 at its bottom end. The top face of the bottom sub 26 is provided with an annular seal 32 spaced radially outward from the threads 27.

Figure 4:
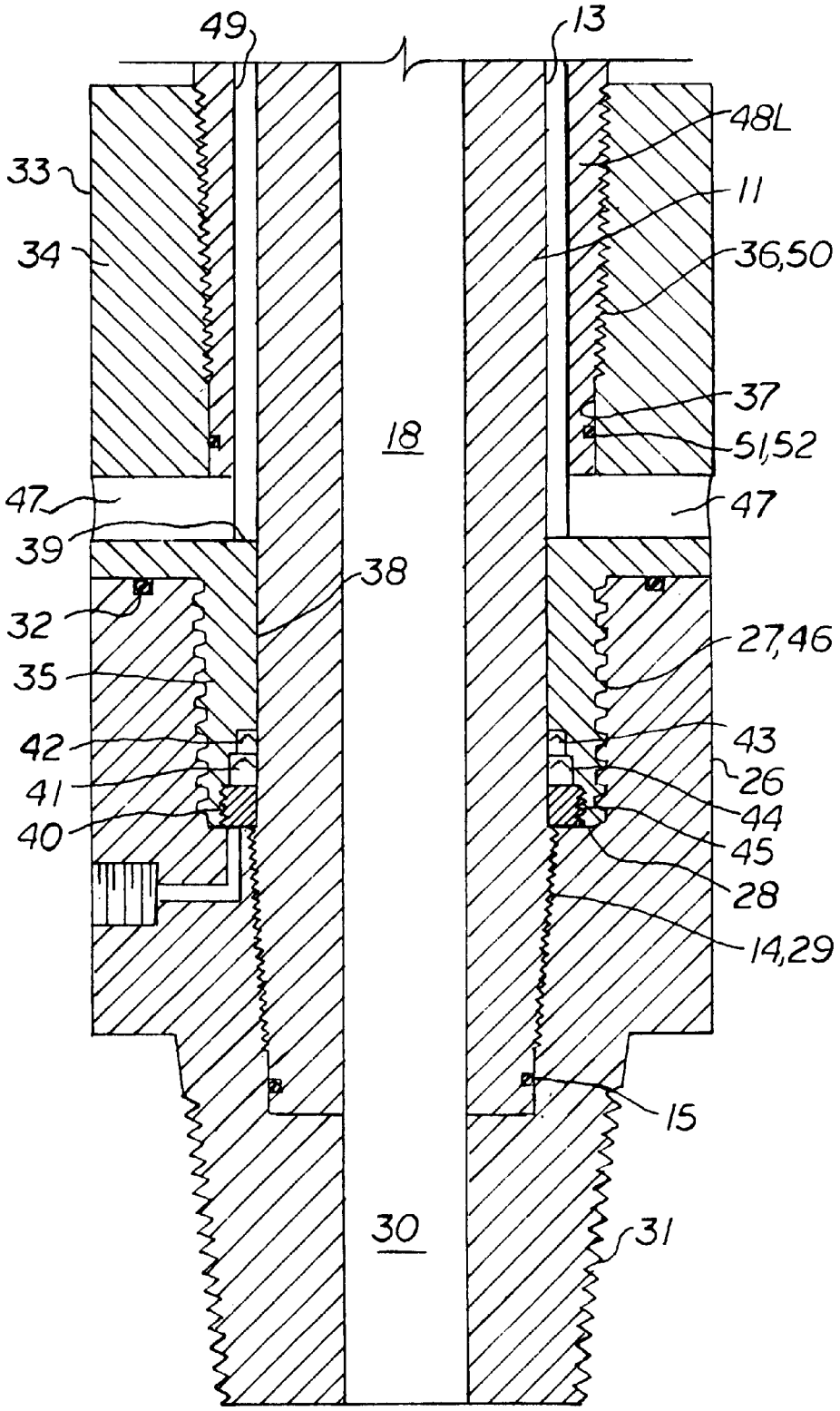
FIG. 4 is a longitudinal cross section through the release sub and bottom sub of the shearable multi-gage blowout preventer test tool.

As best seen in FIGS. 4, 5, 6, and 7, a release sub 33 is slidably mounted on the reduced diameter portion 13 of the inner tube 11. The exterior of the release sub 33 has a larger diameter upper portion 34 and a smaller diameter lower portion 35. The interior of the release sub 33 has female threads 36 extending downwardly from its top end and terminating in a straight bore 37. The release sub 33 has a central bore 38 smaller in diameter than the bore 37 defining an upward facing annular stop shoulder 39 therebetween. As seen in FIGS. 4 and 7, female threads 40 extend upwardly from the reduced diameter bottom end of the release sub and terminate in a first bore 41 and a smaller bore 42. The reduced diameter portion 13 of the inner tube 11 is slidably received through the central bore 38 and surrounded by a seal 43 received in the bore 41 and a pillar block 44 received in the bore 41 and retained by a threaded retaining nut 45 threadedly engaged in the threads 40.

The reduced diameter bottom end of the release sub 33 is provided with coarse left-hand straight male threads 46. At least one port 47 in fluid communication with the interior of the release sub extends radially outward through its side wall to the exterior of the sub.

Figure 2A:
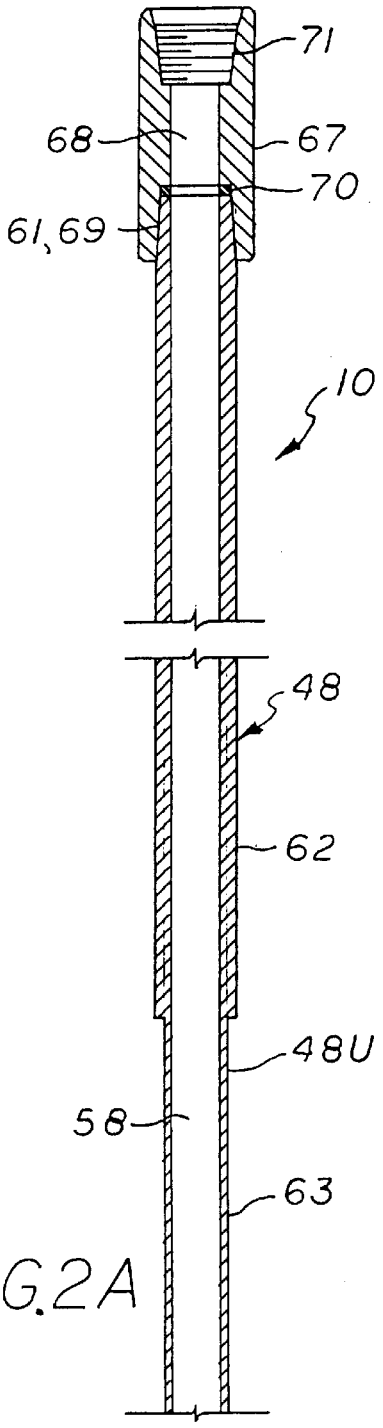
FIGS. 2A and 2B taken together is a longitudinal cross section through the shearable multi-gage blowout preventer test tool showing it in a collapsed position.
Figure 2B:
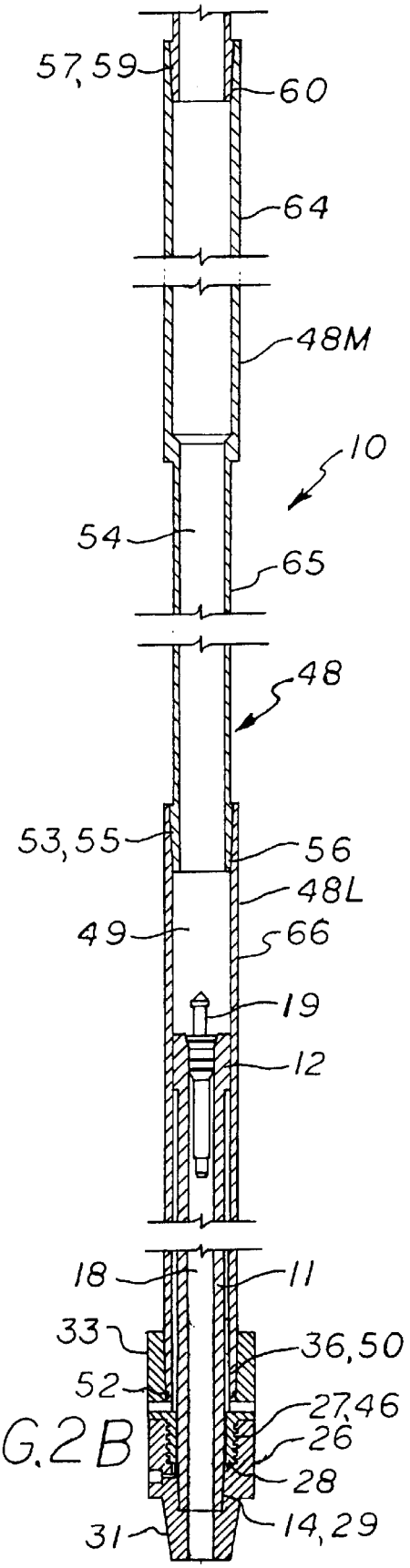
Figure 3A:
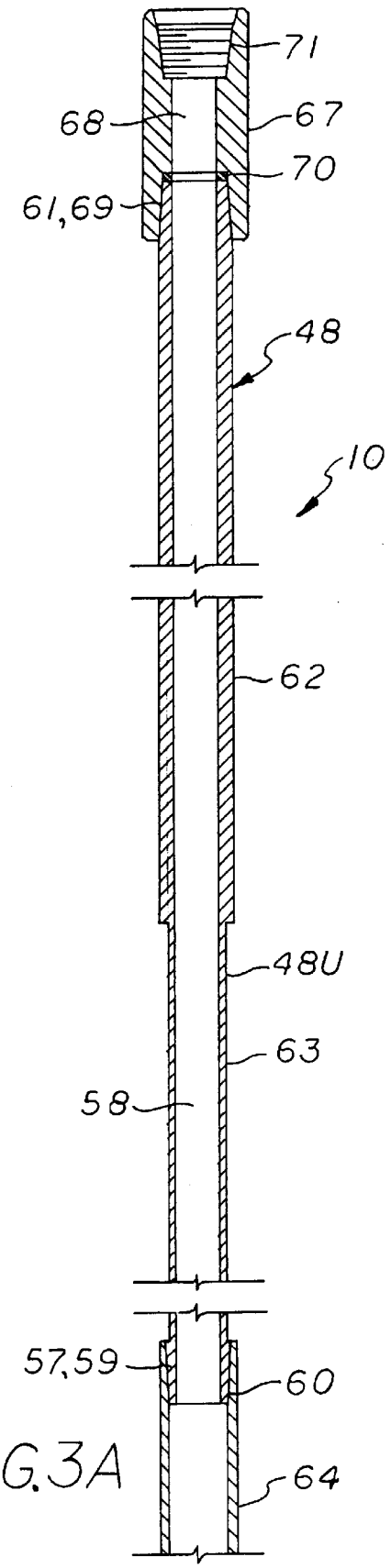
FIGS. 3A and 3B taken together is a longitudinal cross section through the shearable multi-gage blowout preventer test tool showing it in an extended position.
Figure 3B:
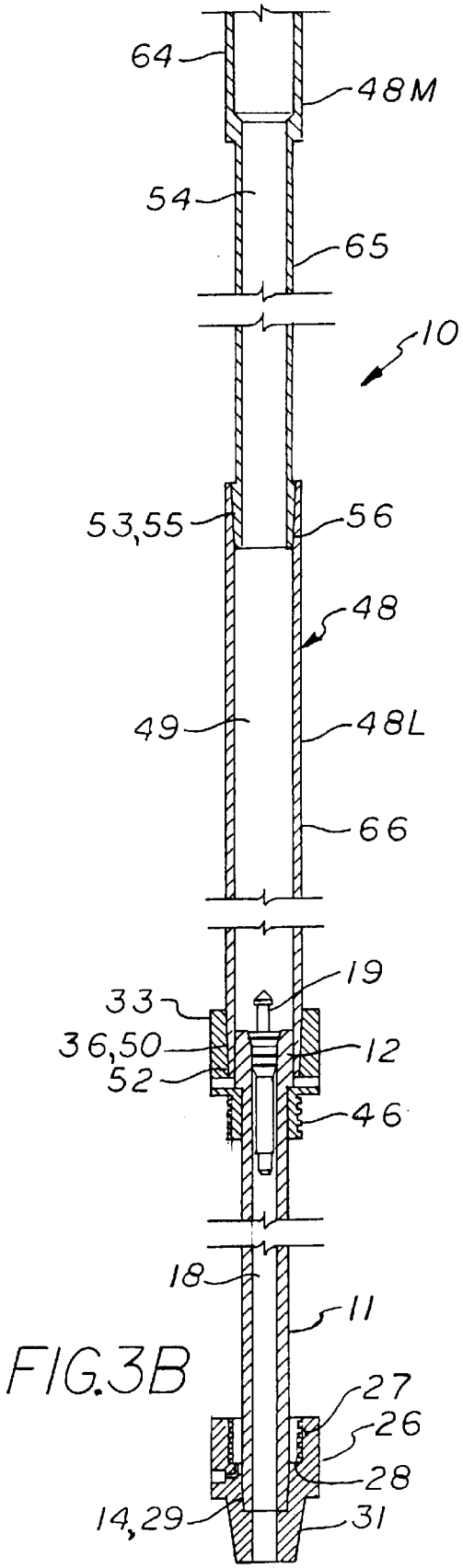

As seen in FIGS. 2B, 4, and 5, the coarse left-hand straight male threads 46 at the bottom end of the release sub 33 are threadedly engaged in the coarse left-hand straight female threads 27 in the top end of the bottom sub 26. The straight left-handed threaded connection 27,46 forms a positive release rotation joint to allow the outer tube assembly 48 to become disengaged or uncoupled from the bottom sub 26 (as seen in FIGS. 3B, 6, and 7) for telescoping action of the test tool 10, as described hereinafter.

The outer test tube assembly 48 includes an elongate tubular lower test tube member 48L, one or more elongate tubular intermediate or middle test tube members 48M, and an elongate tubular upper test tube member 48U. The lower test tube member 48L is connected to the release sub 33 and extends upwardly therefrom. The lower test tube 48L has a central bore 49, male threads 50 at its bottom end which are threadedly engaged in the threads 36 of the release sub 33 and a straight nose portion 51 beneath the threads 50 with an annular seal 52 engaged on the bore 37 to seal the threaded connection 36,50. The lower test tube has female threads 53 in its upper end.

The middle test tube 48M has a central bore 54, male threads 55 at its bottom end which are threadedly engaged in the threads 53 at the top end of the lower test tube 48L and an annular seal 56 beneath the threads 55 which seals the threaded connection 53,55. The middle test tube 48M has female threads 57 in its upper end.

The upper test tube 48U has a central bore 58, male threads 59 at its bottom end which are threadedly engaged in the threads 57 at the top end of the middle test tube 48M and an annular seal 60 beneath the threads 59 which seals the threaded connection 57,59. The upper test tube has male threads 61 at its upper end.

The exterior of the upper test tube 48U has an enlarged pipe gage diameter 62 upper portion and a reduced gage diameter lower portion 63. The exterior of the middle test tube 48M has an enlarged pipe gage diameter 64 upper portion and a reduced gage diameter lower portion 65. The exterior of the lower test tube 48L is also a pipe gage diameter 66. The pipe gage diameters 62, 63, 64, 65, and 66 are machined to correspond to each of the various diameters of the drill pipe used in the well system. Thus, the exterior of the outer test tube assembly 48 is provided with a series of longitudinally spaced pipe gage diameters for testing the blowout preventers.

All the tubular members of the outer test tube assembly 48 that are located across from the shear/blind ram BOP ram are designed to provide a wall thickness sufficient to allow the tubular members to easily be sheared in the event that it becomes necessary.

A top sub 67 is connected to the top end of the upper test tube member 48U. The top sub 67 has a central bore 68 and female threads 69 extending upwardly from the bottom end which receive and threadedly engage the male threads 61 at the top end of the upper test tube 48U, and an annular seal 70 above the threads 69 seals the threaded connection 61,69. The top sub 67 has female threads 71 in its top end which threadedly receive and engage the pin end of the drill pipe string D.

Figure 8:
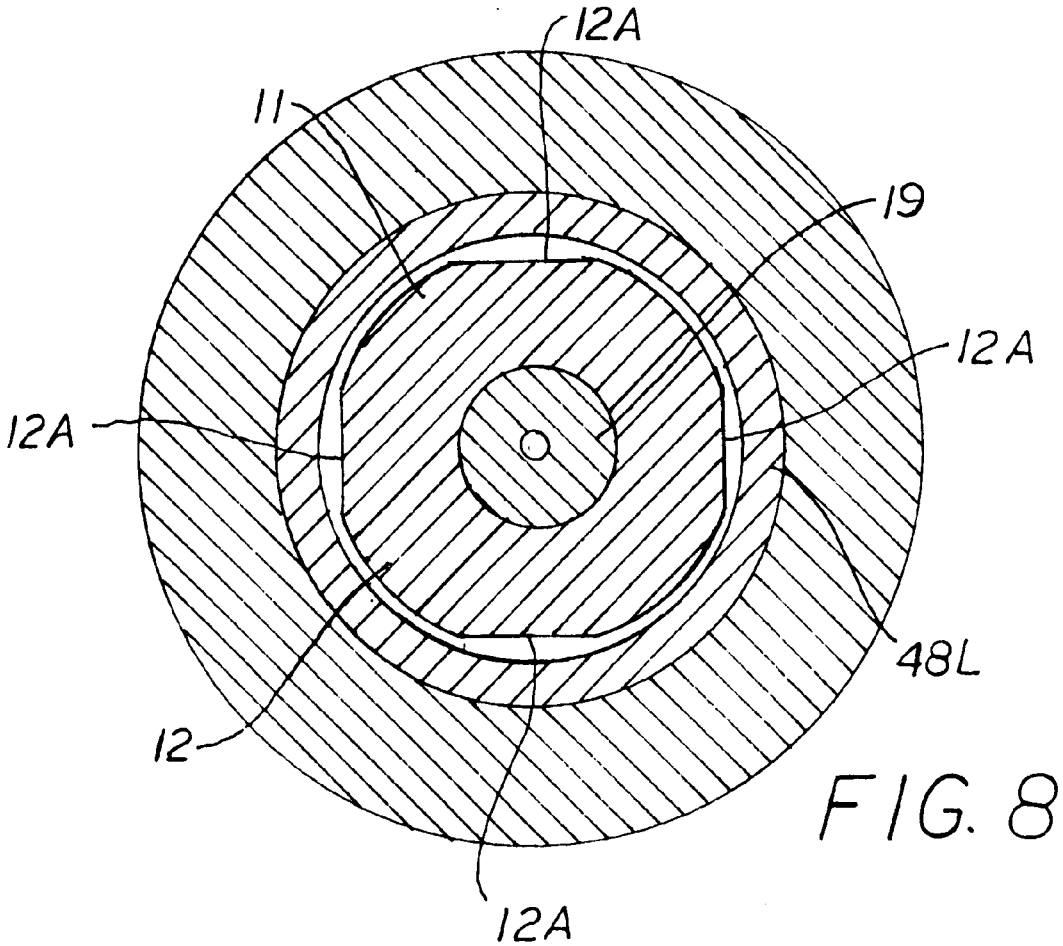
FIG. 8 is a transverse cross section through the upper portion of the inner tube taken along line 8—8 of FIG. 7, showing the fluid bypass passageways.

As seen in FIGS. 7 and 8, the exterior of the enlarged diameter upper portion 12 of the inner tube 11 is provided with longitudinal flats 12A. The outer lower test tube 48L (and test tube assembly 48) and the release sub 33 move axially relative to the inner tube 11. The radial ports 47 in the release sub 33 are in fluid communication with the flats 12A. The flats 12A and the ports 47 provide a fluid and pressure passageway between the interior of the outer test tube assembly 48 and the exterior of the shearable multi-gage test tool.

As seen in FIG. 1, the male threads 31 at the bottom end of the bottom sub 26 are threadedly engaged in the upper end of a conventional test plug P which is to be supported in a casing hanger H a distance below the BOP stack and a tail pipe assembly T (tubing and collars) is threadedly connected to the bottom of the test plug and extends downwardly therefrom.

In operation, the BOP test tool 10 is assembled and the top sub 67 is connected to the lower joint of the drill pipe string and the release sub 33 which is connected at the bottom end of the lower tube 48L is connected to the bottom sub 26 as shown in FIGS. 2B, 4, and 5, and described above. The left-hand threads 46 of the release sub 33 are releasably engaged in the left-hand threads 27 at the top end of the bottom sub 26, and the tool is in the collapsed telescoped position.

The bottom sub 26 is connected to a conventional test plug P and tail pipe assembly T (pipe and collars), and the whole assembly is lowered down through the riser pipe R and BOP stack to set the test plug down in the wellhead casing hanger H. The wireline retrievable dart 19 may be run in place, dropped from the surface, or pumped down after the test plug P has been seated in the casing hanger H. The dart 19 is held firmly in position in the inner tube 11 by drilling fluid flow and pressure acting in its flat surface 21, and the dart seals 25 form a sealing relation with the bores 17 and 18.

A differential hydraulic pressure of the drilling fluid arises due the restriction formed at the upper end of the inner tube 11 by the dart 19 and holds dart in position during the testing operation. The fluid bypasses the inner tube 11 through the flats 12A, and is vented through the ports 47 of the release sub 33 into the BOP stack.

As explained hereinafter, the rams and annular BOPs are tested against a set of corresponding pipe gage diameters on the outer test tube assembly 48 in its collapsed condition, and then the left-hand threads 46 of the release sub 33 are uncoupled from the bottom sub 26 and the outer test tube assembly 48 is lifted to telescope upwardly until the stop shoulder 39 in the release sub 33 contacts the stop shoulder 16 at the bottom of enlarged upper portion 12 of the inner tube 11, and the tool assumes the extended position as shown in FIGS. 2B, 6, and 7. Thus, the stop shoulders 16 and 39 serve as positioning means to position the pipe gage diameters 62–66 relative to the BOP stack in the extended position. The extended position is indicated at the surface by an increase in string weight.

When the tool is in the extended position, another set of the pipe gage diameters on the outer test tube assembly 48 are axially positioned within the BOP stack and the rams and annular BOPs are then tested against the second axially positioned set of corresponding pipe gage diameters.

To insure accuracy in alignment of the pipe gage diameters, a spacer sub (not shown) may be installed between the test plug and the shearable multi-gage blowout preventer test tool to compensate for the variation in the top of the wellhead relative to the ram centerline.

OPERATION

The following is a description of a typical testing operation utilizing the shearable multi-gage blowout preventer test tool.

The test tool is placed in the V-door of the rig and the rig elevators are latched around the tool and the tool is picked up in the derrick. The BOP test tool is connected to the test plug with the tail pipe assembly (25,000 lb. minimum weight recommended) attached.

The left-hand threaded release joint connection between the release sub and bottom sub is checked for complete make up with chain tongs. Seven revolutions are required for make up. Care should be taken to avoid over torquing.

The BOP test tool, test plug, and tail pipe assembly is lowered into the well by the drill pipe. After the test plug is lowered into the BOP stack, the top test sub is made up between the drill pipe and the top drive.

Drilling fluid or mud is circulated down the drill pipe, the BOP test tool, the test plug, and tail pipe to insure that the test assembly and BOP stack is filled with drilling fluid.

After this circulation is completed, the dart is dropped down the drill pipe. Drilling fluid or mud is then pumped down the drill pipe string to insure that the capacity of the BOP test tool has been circulated and the dart is seated.

The string weight is recorded, and the tool is lowered to seat the test plug in the wellhead.

The ram or annular BOPs are closed and are tested in accordance with the manufacturer's test procedure by testing down the drill pipe.

The ram BOPs (including Variable Bore Ram) are tested against the corresponding pipe gage diameters of the outer test tube assembly of the BOP test tool. The annular BOPs are tested against the corresponding pipe gage diameters of the outer test tube assembly of the BOP test tool.

After all the appropriate ram and annular BOPs and valve tests have been performed against the corresponding pipe gage diameters, the drill pipe is pick up to obtain neutral weight at the wellhead. The drill pipe is rotated slowly to the right to release the outer test tube assembly (release sub) from the bottom sub. Seven right-hand turns at the wellhead is required to release the lower outer test tube and allow telescoping motion. The test tool can them be telescoped out (extended).

The motion compensator is engaged and the drill pipe and outer test tube assembly is lifted (telescoped upward) until the stop shoulder in the release sub contacts the stop shoulder at the upper end of the inner tube. The inner tube, test plug, and tail pipe assembly, will remain stationary. The pick up weight will be less this weight (the weight of the tail pipe, test plug and inner tube, i.e., +/−25,000 lbs.). The pick up weight will increase (indicated by the weight indicator) when the outer test tube assembly is extended and contact with the stop shoulder is made. Care should be taken not to pick up more than 5,000 lbs. above the weight of the drill string less weight of the inner tube, test plug, and tail pipe, so that the test plug will not be unseated. The weight indicated by the weight indicator is recorded.

The motion compensator will maintain the BOP test tool in the extended position while the second set of tests are performed.

The ram and annular BOPs are closed and tested in accordance with the manufacturer's recommended test procedure. The ram BOPs (including Variable Bore Ram) are tested against the corresponding pipe gage diameters of the outer test tube assembly, and the annular BOPs are tested against the corresponding pipe gage diameters of the outer test tube assembly.

All tests are performed down the drill pipe. If elected to do so, tests can be performed down the choke or kill lines and pressure will also be on the drill pipe.

After all tests are complete the ram and annular BOPs are opened, and the drill pipe, BOP test tool, test plug, and tail pipe assembly is pulled out of the wellbore. If desired, the dart can be retreived prior to pulling the drill string.

After the drill pipe is retreived from the wellbore, the test plug is set in the rotary and, if not previously removed, the dart is removed from the test tool with the retreiving tool or wireline overshot.

The BOP test tool is then cleaned, the left-hand threads of the release sub are made up in the top of the bottom sub with chain tongs, and BOP test tool is now ready for use again when needed.

While this invention has been described fully and completely with special emphasis upon a preferred embodiment, it should be understood that within the scope of the appended claims the invention may be practiced otherwise than as specifically described herein.

I claim:

1. A shearable multi-gage blowout preventer test tool for testing different size ram and annular subsea blowout preventers in one trip, comprising:

an inner tube;

a lower connecting member at a lower end of said inner tube for connecting said inner tube assembly to a wellhead sealing tool;

an outer test tube assembly surrounding said inner tube and having a plurality of longitudinally spaced pipe gage diameters formed on an exterior surface thereof corresponding in size to outside diameters of different drill pipe diameters;

said outer test tube assembly having a wall thickness sufficient to allow it to be sheared in the event that it becomes necessary;

releasable and connectable coupling means at a lower end of said outer test tube assembly for selective connection to said lower connecting member to allow axial telescoping movement of said outer test tube assembly relative thereto and to said inner tube in a released condition, and to prevent relative movement relative thereto in a connected condition;

an upper connecting member at an upper end of said outer test tube assembly for connecting said test tube assembly to a drill pipe string and moving said outer test tube axially;

in said connected condition, a first set of said longitudinally spaced pipe gage diameters of said outer test tube assembly being positioned within said blowout preventers for testing said blowout preventers against said first set of pipe gage diameters; and in said released condition, a second set of said longitudinally spaced pipe gage diameters of said outer test tube assembly being positioned within said blowout preventers for testing said blowout preventers against said second set of pipe gage diameters.

2. The shearable multi-gage blowout preventer test tool according to claim 1, wherein said upper connecting member, said outer test tube assembly, and said inner tube each has a central bore in communication with the interior of said drill pipe string, and said inner tube central bore has a shut-off receiving and seating surface at an upper end thereof for receiving a shutoff member, and fluid flow bypass passageways isolated from said shut-off receiving and sealing surfaces;

said lower connecting member has a central bore in communication with said inner tube central bore and with a central bore of said wellhead sealing tool;

said coupling means at a lower end of said outer test tube assembly has a port extending radially between its interior and exterior in fluid communication with said inner tube fluid flow bypass passageways; and upon a shut-off member being received and seated in said shut-off receiving and seating surface at said upper end of said inner tube, drilling fluids conducted from said drill pipe string pass through said said upper connecting member central bore, said outer test tube assembly central bore, through said inner tube fluid flow bypass passageways, and through said port of said coupling means; whereby fluids may be circulated through said tool during testing operations.

3. The shearable multi-gage blowout preventer test tool according to claim 2, further comprising a shut-off member removably received in said shut-off receiving and seating surface at said upper end of said inner tube.

4. The shearable multi-gage blowout preventer test tool according to claim 3, wherein said shut-off member is a wireline retrievable dart having sealing surfaces at an upper end engageable in sealing relation on said shut-off receiving and seating surface at said upper end of said inner tube.

5. The shearable multi-gage blowout preventer test tool according to claim 4, wherein said dart has an enlarged surface area at an upper end beneath said upper connecting member upper central bore whereby said dart is maintained engaged in sealing relation in said shutoff receiving and seating surface at said upper end of said inner tube by drilling fluids and pressure conducted through said outer test tube assembly central bore.

6. The shearable multi-gage blowout preventer test tool according to claim 1, further comprising positioning means connected between said inner tube and said outer test tube assembly for positioning said second set of said longitudinally spaced pipe gage diameters of said outer test tube assembly within said blowout preventers when said outer test tube assembly is in said released condition.

7. A method for testing different size ram and annular subsea blowout preventers in one trip in a subsea well, comprising the steps of:

providing a shearable multi-gage blowout preventer test tool having an inner tube, a lower connecting member at a lower end of said inner tube for connecting said inner tube to a wellhead sealing tool, an outer test tube assembly surrounding said inner tube and having a plurality of longitudinally spaced pipe gage diameters formed on an exterior surface thereof corresponding in size to outside diameters of different drill pipe diameters, releasable and connectable coupling means at a lower end of said outer test tube assembly for selective connection to said lower connecting member, and an upper connecting member at an upper end of said outer test tube assembly for connecting said test tube assembly to a drill pipe string;

connecting said upper connecting member to a drill pipe string;

connecting said inner tube and said releasable and connectable coupling means to said lower connecting member;

connecting said lower connecting member to said wellhead sealing tool;

lowering said multi-gage blowout test tool and said wellhead sealing tool through said subsea blowout preventers to set said wellhead sealing tool in said subsea well;

testing said blowout preventers against a first set of said longitudinally spaced pipe gage diameters with said outer test tube assembly positioned within said blowout preventers and said releasable and connectable coupling means in said connected condition;

uncoupling said releasable and connectable coupling means from said lower connecting member;

raising said outer test tube assembly to position a second set of said longitudinally spaced pipe gage diameters of said outer test tube assembly within said blowout preventers; and testing said blowout preventers against said second set of pipe gage diameters.

8. The method according to claim 7, including the step of conducting drilling fluids through said multi-gage blowout preventer test tool during said testing of said blowout preventers.

* * * * *